United States Patent [19]

Ma

[11] Patent Number: 4,577,598

[45] Date of Patent: Mar. 25, 1986

[54] INTERNAL COMBUSTION ENGINE AND CAM DRIVE MECHANISM THEREFOR

[75] Inventor: Thomas T. Ma, Chelmsford, United Kingdom

[73] Assignee: Ford Motor Company, Dearborn, Mich.

[21] Appl. No.: 696,674

[22] Filed: Jan. 30, 1985

Related U.S. Application Data

[62] Division of Ser. No. 386,851, Apr. 9, 1982, abandoned.

[51] Int. Cl.[4] ..... F01L 1/34

[52] U.S. Cl. ..... 123/90.18; 123/90.15; 464/2

[58] Field of Search ..... 123/90.15, 90.17, 90.18; 464/2

[56] References Cited

U.S. PATENT DOCUMENTS

| | | | |
|---|---|---|---|
| 2,191,459 | 2/1940 | Duncan | 123/90.17 |
| 3,174,303 | 3/1965 | Watson | 464/2 |
| 3,401,572 | 9/1968 | Bailey | 123/90.15 X |

FOREIGN PATENT DOCUMENTS

| | | | |
|---|---|---|---|
| 1810368 | 6/1970 | Fed. Rep. of Germany | 123/90.15 |

*Primary Examiner*—William R. Cline
*Assistant Examiner*—Peggy A. Neils
*Attorney, Agent, or Firm*—Clifford L. Sadler; Robert E. McCollum

[57] ABSTRACT

An internal combustion engine has n member of cylinders, a piston in each cylinder connected to a crankshaft (2), each piston being in phase or out of phase with the others by A° or a multiple thereof (A=720/n), cams for actuating inlet and exhaust valves to each cylinder, and a cam drive mechanism (5) which rotates the cams in phased relationship with the crankshaft (2) to open the valves in sequence for a desired angle of rotation of the crankshaft. The cam drive mechanism also includes means for combining the rotational movement of the cams with a phased oscillatory movement of the camshaft (3) and cams of variable amplitude about the axis of rotation at a frequency f times the crankshaft frequency so that over the period which the valves are opened and/or their timings variable, f has the following values:

f=2n when the number of cylinders n=1;

f=n or n/2 when n=2;

and f=n/2 when n=3 or more. The selection of the frequency of the oscillations allows all the cams to be mounted on the same camshaft.

4 Claims, 16 Drawing Figures

(a)
mm
A
B
C
D
180° (BDC)
360° (TDC)
540° (BDC)
(b)
0
180°
360°
540°
ANGLE OF CRANKSHAFT ROTATION

INTERNAL COMBUSTION ENGINE AND CAM DRIVE MECHANISM THEREFOR

This is a Division of application Ser. No. 386,851, filed Apr. 9, 1982, now abandoned.

TECHNICAL FIELD

This invention relates in general to internal combustion engines, and more particularly to cam drive mechanisms therefor.

BACKGROUND ART

A conventional internal combustion engine comprises a set of cylinders arranged in line, a piston reciprocable in each cylinder and connected to a crankshaft, each piston being either in phase or out of phase with the others by a phase angle A° or an integral multiple thereof, a plurality of rotatable cams for actuating inlet and exhaust valves of each cylinder, and a cam drive mechanism for rotating the cams in a predetermined phase relationship with the crankshaft to open each valve in sequence through a desired angle of rotation of the crankshaft. In a conventional 4-stroke engine, the cam drive mechanism rotates the cams once for every two rotations of the crankshaft.

Such drive mechanism suffer from the disadvantage that the periods (i.e., angles of rotation of the crankshaft) for which the valves are opened during each cycle of the engine are fixed. In practice, the optimum periods vary with the operating conditions of the engine. For example, when the engine is operating at high speeds, maximum power would be achieved by opening the inlet and exhaust valves for relatively longer periods within each cycle, whereas at low engine speeds and low loads, shorter operating periods improve the fuel efficiency of the engine. An improvement of fuel efficiency at low speeds could also be obtained by altering the operation of the exhaust and inlet valves to reduce the period for which both valves are open together.

British Patent Specification No. 1522405 discloses a cam drive mechanism that includes means for varying the angle of rotation of the camshaft through which the valves are opened to suit varying engine operating conditions. This is achieved by combining the rotational movement of the cams with oscillations about their axis of rotation which also have a predetermined phase relationship with the crankshaft and varying the amplitude of these oscillations to match the change in the period for which the valves are opened to the engine conditions.

The drive mechanism described in British Patent Specification No. 1522405 comprises an intermediate drive shaft driven at half the speed of the crankshaft and connected to the camshaft by an eccentric coupling. Displacement of the axis of rotation of the intermediate drive shaft radially with respect to the axis of the camshaft produces a combined rotational and oscillatory movement in the camshaft, the frequency of the oscillatory movement being equal to the frequency of rotation of the camshaft. However, in the construction described in that specification, the required phases of these oscillations differ for each cam and, therefore, an individual eccentric coupling driving an individual camshaft is required for each cylinder. Hence, the drive mechanism is relatively complicated and expensive to produce in a multi-cylinder engine.

DISCLOSURE OF INVENTION

The present invention is based upon the appreciation that, in an engine having a set of n number of cylinders in which each piston is either in phase with or A° (or an integral multiple of A°) out of phase with the other pistons in the set, the combination of the rotational movement of the cams with angular oscillations (displacements) of a frequency of n/2 of that of the crankshaft, produces, for the valves of all the cylinders, the same variation timing of the valves in relation to the rotation of the camshaft. This permits all the valves to be driven from the same camshaft, while allowing variations in their timings to suit engine operating conditions.

According to the present invention therefor, there is provided a cam drive mechanism for driving a camshaft of a 4-stroke internal combustion engine, the engine comprising one or more sets of n cylinders, wherein n is a positive integer, a piston connected to a crankshaft and reciprocable in each cylinder and being either in phase or out of phase with any other piston in the set to which it belongs to by a phase angle A°, or an integral multiple thereof, and a camshaft carrying a plurality of rotatable cams for actuating inlet and/or exhaust valves to each cylinder in the set, the cam drive mechanism comprising means for rotating the camshaft with a rotational movement that is a combination of a regular circular motion about its axis, which has a predetermined phase relationship with the crankshaft, and an oscillatory motion about its axis which also has a predetermined phase relationship with the crankshaft, and means for varying the amplitude of the oscillatory motion whereby the timing of the valves may be varied; characterized in that the speed of the circular motion is half the speed of rotation of the crankshaft, and the oscillatory motion has a frequency f times the frequency of rotation of the crankshaft wherein:

f=2n when the number of cylinders n=1;

f=n or n when n=2; and 2 f=n when n=3 or more. 2

The invention also includes an internal combustion engine comprising one or more sets of n cylinders, a piston connected to a crankshaft reciprocable in each cylinder and being either in phase with or out of phase by an angle A°, or an integral multiple thereof, with any other piston in the set to which it belongs, and a plurality of rotatable cams for actuating inlet and/or exhaust valves to each cylinder; characterized in that, for each set of cylinders, the cams are mounted on a respective common camshaft and each camshaft is driven by a cam drive mechanism according to the invention.

Thus, where there is more than one cylinder, the engine may be of the type in which there is only one set of pistons, and the valves of all the cylinders in the engine are driven by the same common camshaft. For example, the engine may comprise a plurality of cylinders arranged inline, or two banks of cylinders arranged in a V-configuration, the valves of which are all driven from a single, centrally positioned camshaft. Alternatively, the engine may be of the flat or V-type in which the cylinders are arranged in two sets, all the valves in each set being operable by their respective common camshaft. In the latter case, a cam drive mechanism would be required for each camshaft.

In a further alternative, the engine may be of the twin camshaft type in which the inlet valves are all driven from one common camshaft and the outlet valves are driven from another camshaft. Again, two cam drive mechanisms would be required.

The invention is especially suitable for engines where the number of cylinders n is 3 or more, and especially to engines where n=4.

The cam drive mechanism may be of any suitable construction. One general type of cam drive mechanism comprises a rotatable drive member driveable by the crankshaft, and a connection for transmitting rotational movement of the drive member to the camshaft that permits relative angular movement between the camshaft and the drive member, and means for causing oscillations in the relative angular orientation of the drive member and the camshaft.

For example, in one embodiment of the invention incorporating a cam drive mechanism of this type, the drive mechanism includes an epicyclic gear train having a sun gear member, planet gear members, a planet carrier member, and a ring gear member, one member being driveable by the crankshaft, another member being adapted for connection to the camshaft, with means for oscillating a third member to vary the relative angular orientation between the other two members. For example, if the sun gear is arranged to be driven by the crankshaft and the planet gear carrier is arranged to drive the camshaft, oscillation of the ring gear will vary the relative angular orientations between the sun and planet gear carrier.

In this arrangement, the oscillating means preferably comprises a link connected at one end to the said third member and at the other end to a rotary member driveable by the crankshaft.

The rotary member may comprise a simple crank, in which case the means for varying the amplitude of the oscillations may comprise a pivot slideable along the link with means for adjusting the position of the pivot along the link.

In an alternative embodiment of the invention incorporating a cam drive mechanism of the aforementioned general type, the connection between the drive member and the camshaft comprises an axially reciprocable helically splined element, and means for axially reciprocating the said element to effect the variation in the relative angular orientation of the camshaft and the drive member. The helically splined element may, for example, comprise a tube having internal and external splines engaging with the drive member and the camshaft, one of the sets of splines being helical.

A cam mechanism may conveniently be used to effect reciprocation of the splined element. In a preferred embodiment of the invention, the cam mechanism comprises a ball bearing race, one track of which is formed by a radial face of the splined element, the other track being formed by a fixed radial face, one of the tracks having circumferential undulations, ball bearings positioned between the two races, and means for biasing the splined element towards the radial face. With this construction, the axial depths of the undulations preferably vary in the radial direction and the means for varying the amplitude of the oscillations varies the radial position of the ball bearings in relation to the one radial face.

In a further alternative embodiment of the invention of the aforementioned general type, the cam drive means comprises a first drive wheel adapted to be driven by the crankshaft, a second drive wheel adapted to drive the camshaft, a drive belt interconnecting the two drive wheels and means for cyclically varying the relative lengths of the runs of drive belt between the two drive wheels to effect the combination of the rotary movement with the oscillations.

The means for cyclically varying the relative lengths of the runs of the drive belt or chain preferably comprises two idler wheels over each of which passes a respective one of the runs of the drive belt or chain, the idler wheels being mounted for movement in synchronism to displace the drive belt or chain in opposite radial directions.

A second general type of cam drive mechanism which may be used in the present invention comprises a rotatable drive member adapted to be connected between the crankshaft and the camshaft by means of an eccentric coupling which superimposes the oscillations on the rotational movement produced by the drive member, and the means for varying the amplitude of the oscillations comprises means for varying the eccentricity of the eccentric coupling.

In one embodiment of the invention incorporating this second general type of cam drive mechanism, the rotatable member is adapted to be driven from the crankshaft at f times the speed thereof where f is as defined previously, and the eccentric coupling comprises a rotatable intermediate member driven by the drive member, the intermediate member and the drive member are eccentric to each other, and the intermediate member is drivingly connected to the camshaft through an appropriate change speed gear to drive the camshaft at half the speed of the crankshaft. The change speed gear will be a reduction gear having a ratio of 2f:1.

Although either the drive member or the intermediate member may be movable, preferably the intermediate member is movable relative to the drive member so that adjustment of the cam drive mechanism does not involve movement of any drive belt or chain between the crankshaft and the drive member.

Any convenient linkage may be used between the drive member and the intermediate member. Preferably the drive member is connected to the intermediate member by a pin which is mounted in one member eccentrically with respect to the axis of rotation of that member and which engages in a radial slot in the other member. This connection is less susceptible to wear than, for example, alternative connections involving pivoted links. The intermediate member may be connected to the reduction gear through any suitable connection which transmits the rotational movement thereof but which can accommodate the movement of the intermediate member. For example, the intermediate member may be connected to the reduction gear via universal joints, or sliding rotary connections such as an Oldhams coupling.

In a preferred embodiment of the invention, the intermediate member is connected to a rotatable member of the reduction gear by a pin which is mounted in one of the members eccentrically with respect to the axis of rotation of that member, and which engages a radial slot in the other member.

BEST MODE FOR CARRYING OUT THE INVENTION

Other features and advantages of the invention will become more apparent upon reference to the succeeding, detailed description thereof, and to the drawings illustrating the preferred embodiments thereof.

Figure 1:
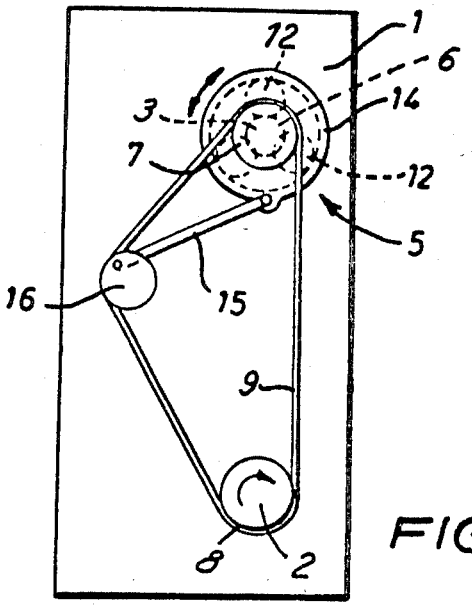
FIG. 1 schematically illustrates the front elevational view of one engine constructed in accordance with the invention.
Figure 2:
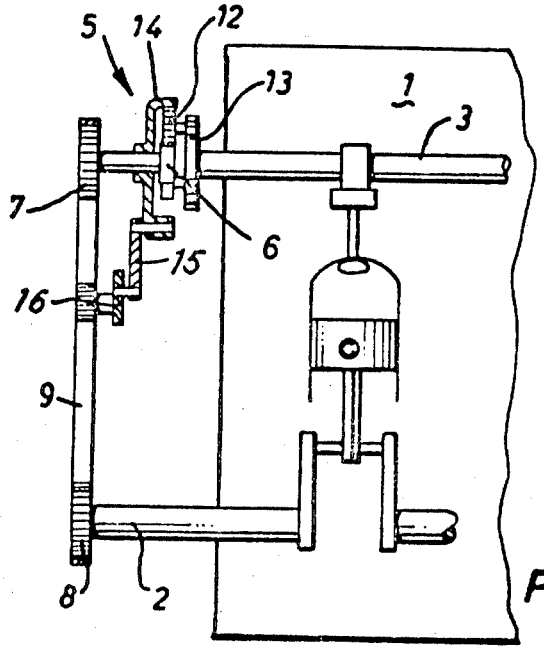
FIG. 2 is a schematic partial cross section through the engine of FIG. 1.
Figure 3:
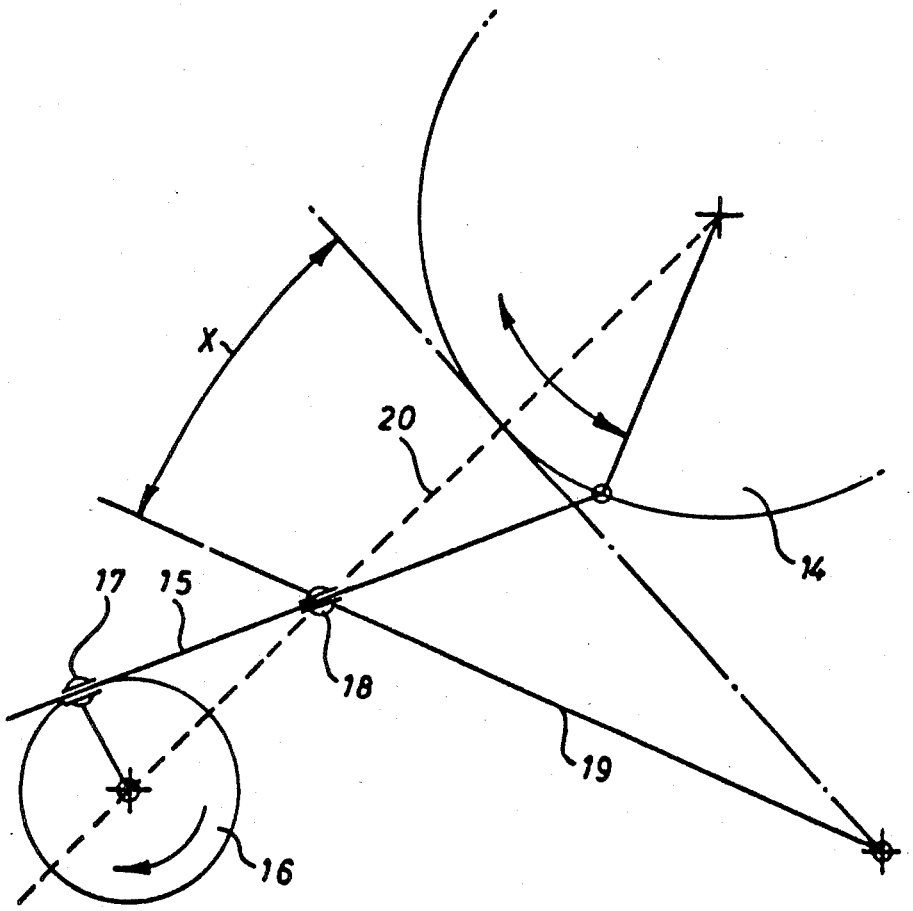
FIG. 3 is a sketch showing the kinematics of a detail of the engine of FIGS. 1 and 2.

Referring to FIGS. 1 to 3, therefore, the invention will first be described in relation to a 4-stroke internal combustion engine 1 which has a single set of four cylinders arranged in line, each having a piston connected to a crankshaft 2 in a conventional manner. Each cylinder has an inlet valve and an outlet valve, and all eight valves are arranged to be opened in sequence by means of a respective cam and rocker, all the cams being mounted on a single rotatable camshaft 3.

Since the person skilled in the art will be familiar with the construction and arrangement of crankshaft, pistons, valves and cams, all of which are conventional, these components are only illustrated schematically in the drawings.

The camshaft 3 is driven from the crankshaft 2 by a cam drive mechanism which comprises an epicyclic gear train, indicated generally at 5 in FIGS. 1 and 2. The gear train 5 comprises a sun gear 6 which is fixed to a drive wheel 7 which is, in turn, coupled to a drive sprocket 8 on the crankshaft 2 by a timing belt or chain 9. The sun gear 6 engages with a number (three illustrated) of planet gears 12 mounted on a carrier 13 which is fixed to the camshaft 3. The planet gears 12 also mesh with a ring gear 14. The gear ratio of the gear train 5 is such as to drive the camshaft at half the speed of the crankshaft.

As best seen in FIGS. 1 and 3, the ring gear 14 is connected to one end of a link 15, the other end of which is connected to a rotatable crank wheel 16 by a sliding coupling 17. The crank wheel 16 engages with the timing belt or chain 9 so as to be driven from the crankshaft 2 at twice the speed of rotation of the crankshaft. The link 15 carries a pivot 18 which is slidable along the length of the link 15. The pivot is also slidably mounted on a control lever 19 which has a fixed pivot at one end to the engine for movement through an angle X between the positions illustrated in broken and solid lines in FIG. 3. The pivot 18 is itself slidable along a track 20 arranged along the line between the centers of the ring gear 14 and the crank wheel 16.

When the control lever 19 occupies the position illustrated in broken lines in FIG. 3, the sliding pivot 18 will lie at the end of link 15 adjacent the ring gear 14. The rotational movement of the crank wheel 16 therefore produces little or no movement of the ring gear 14 since rod 15 merely pivots about its end which is now essentially stationary. The gear train 5 therefore rotates the camshaft with a circular motion having a fixed phase with the crankshaft and a speed equivalent to half the crankshaft speed.

As the control lever 19 is moved back through the angle X, rotation of the crank wheel 16 produces oscillations back and forth of the ring gear 14 at a frequency equal to twice the frequency of rotation of the crankshaft 2; i.e., at the same frequency as the drive of crank wheel 16. The amplitude of the oscillations will increase progressively as the control lever 19 moves towards the position illustrated in solid lines in FIG. 3. The oscillations of the ring gear 14 also cause the planet gears 12 to roll back and forth around the sun gear, varying their relative angular orientation, and transmitting the oscillatory movement of the ring gear to the camshaft 3 through the planet carrier.

Figure 4:
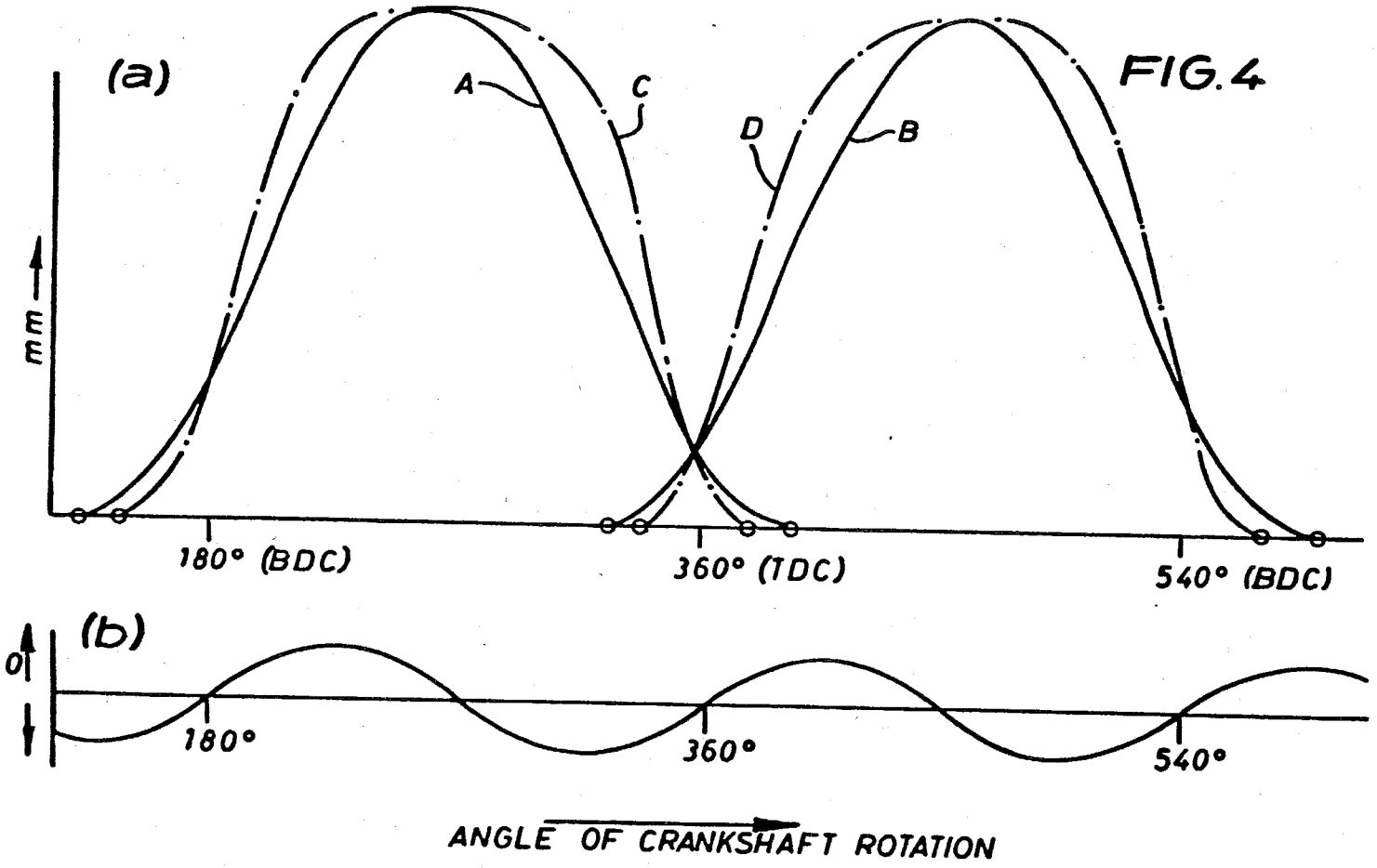
FIGS. 4 and 5 are graphical illustrations of the operation of the inlet and exhaust valves of the engine in FIGS. 1 to 4.

The combined circular and oscillatory movement of the camshaft is illustrated graphically in FIG. 4. FIG. 4(a) illustrates the phase relationship between the opening and closing movements of the inlet and exhaust valves and the crankshaft 2 during one complete revolution of the crankshaft, the angle of rotation of the crankshaft being plotted in degrees on the abscissa of the graph, the movement of the inlet and exhaust valves in millimeters being plotted on the ordinate.

The solid-line curves A and B respectively illustrate the movements of the exhaust and inlet valves when the ring gear 14 is not subjected to any oscillation. The exhaust valve begins to open at 50° before the piston reaches the bottom dead center (BDC) position and closes again about 35° after the piston has reached the top dead center (TDC) position. The exhaust valve is therefore opened through 265° of the rotation of the crankshaft 3. The inlet valve begins to open about 35° before the piston has reached TDC and closes about 50° after the piston has again reached BDC. The inlet valve is therefore also opened through 265° of rotation of the crankshaft.

If the control lever 19 in FIG. 3 is adjusted to oscillate the ring gear 14, similar oscillations are produced in the camshaft 3. The phase relationship of these oscillations with the crankshaft is illustrated in FIG. 4(b). It will be observed that the frequency of the oscillations is twice that of the crankshaft; hence, two cycles of oscillations occur for each rotation of the crankshaft. The broken line curves C and D in FIG. 4(a) respectively illustrate the movements of the exhaust and inlet valves when the rotational movement of the camshaft generated by the crankshaft is combined with the oscillations. As illustrated, the oscillations modify the circular movement of the camshaft so that the exhaust valve now opens about 30° before BDC and closes about 20° after TDC, and the inlet valve opens about 20° before TDC and closes about 30° after BDC. The valves are therefore each now open during 230° of rotation of the crankshaft. By varying the amplitude of the oscillations, the periods for which the inlet and exhaust valves are opened may be varied.

Figure 5:
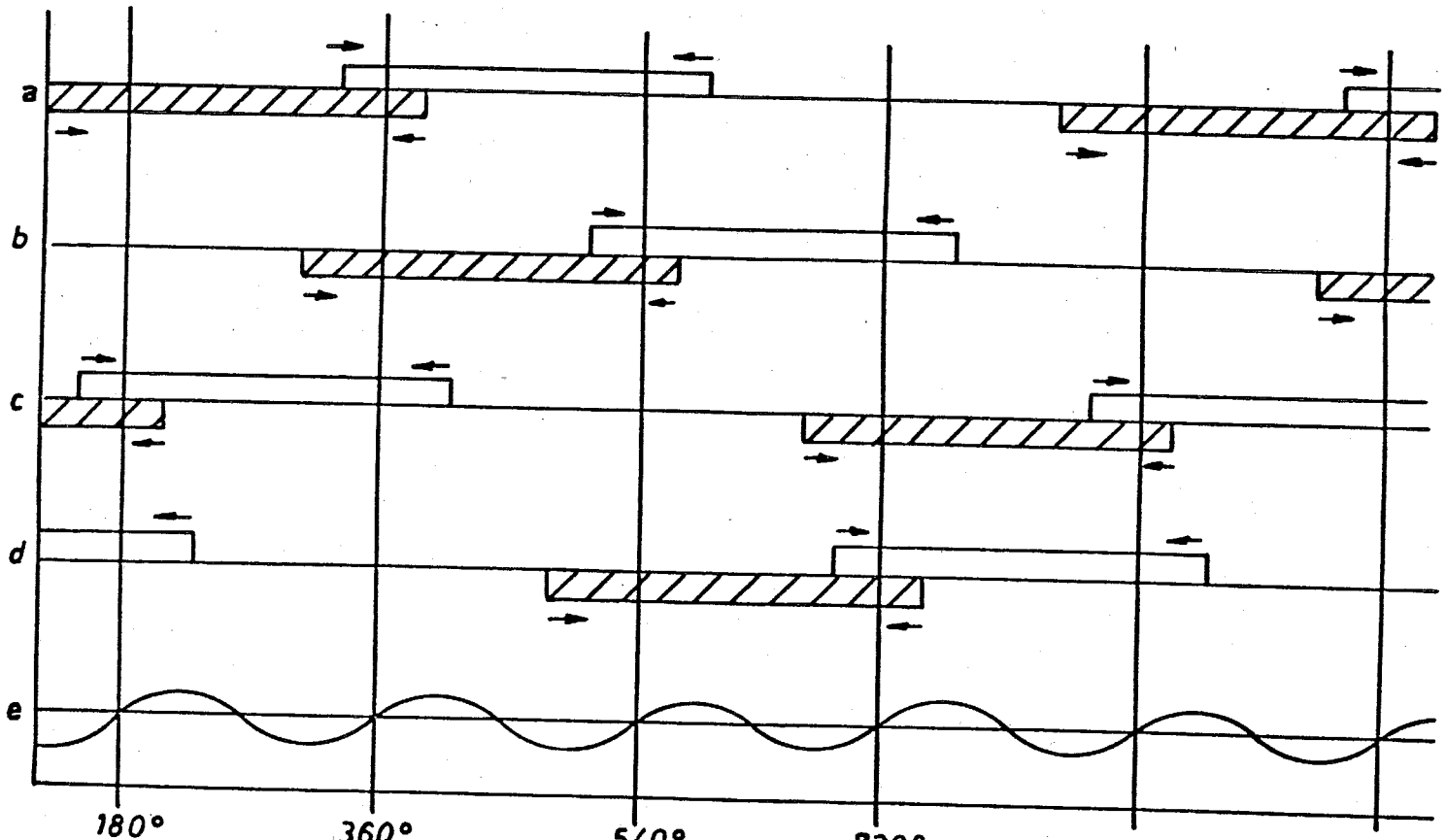

FIG. 5 illustrates the effect of the oscillations of the camshaft on the inlet and exhaust valves for the three other cylinders of the engine. The phase relationship between the opening of the inlet and exhaust valves of the first, second, third and fourth cylinders are illustrated at (a) to (d) respectively. The shaded areas represent the opening of the exhaust valves, the unshaded area representing the opening of the inlet valves. FIG. 5(e), like FIG. 4(b), illustrates the phase relationship between the rotation of the crankshaft and the oscillations of the camshaft.

FIG. 5(a) is similar to FIG. 4(a), but illustrates a full 360° of movement of the camshaft. Since the camshaft is driven at half the speed of the crankshaft, this represents 720° rotation of the crankshaft. During this period, four complete cycles of oscillations are generated. The oscillations result in reductions in the angle of rotation of the crankshaft through which the exhaust or inlet valves are opened, as illustrated by the arrows in FIG. 5(a), as explained previously.

Referring to FIG. 5(b), the piston in the second cylinder of the engine is out of phase with the first cylinder by 180° based on the two complete revolutions of the crankshaft required to complete one combustion cycle in the engine. The exhaust and inlet valves therefore open 180° after those of the first cylinder. Since the oscillations applied to the crankshaft have a frequency of twice the frequency of rotation of the crankshaft, the difference in phase of the valves in the second cylinder relative to those of the first cylinder is equivalent to one complete cycle of oscillation. Consequently, the oscillations vary the angle of rotation of the crankshaft through which the valves of the second cylinder are opened by exactly the same amount as the valves of the first cylinder.

Referring to FIG. 5(c), the third cylinder is 540° out of phase with the first cylinder and 360° out of phase with the second cylinder. The exhaust and inlet valves therefore open 540° and 360° after those of the first and second cylinders respectively. These phase differences correspond to three and two complete cycles of oscillations. Again, therefore, the angles of rotation of the crankshaft through which the valves of the third cylinder are opened are varied by the oscillations by exactly the same amount as the first and second cylinders.

Similarly, as seen in FIG. 5(d), since the fourth cylinder is 360°, 180° and 180° out of phase with the first, second, and fourth cylinders, respectively, which each correspond to an integral number of cycles of oscillation, the exhaust and inlet valves of the fourth cylinder are subjected to the same variation in opening period as the valves of the other three cylinders.

It will be appreciated that the above conditions will apply in engines with any number of cylinders, provided that the pistons are in phase or out of phase with each other by 180° or an integral multiple thereof. In such an engine, therefore, all the valves can be driven from a common crankshaft.

FIGS. 6 to 10 illustrate the operation of alternative embodiments of the invention applied to engines having varying numbers of cylinders. In general, in a 4-stroke engine having n pistons out of phase with each other by equal amounts, the difference A in phase angle between any two pistons in relation to the two complete rotations of the crankshaft required to operate the 4-stroke engine cycle, will be 720/n degrees of crankshaft rotation or an integral multiple thereof. The operation of the valves for each cylinder will also be out of phase with each other by this amount. In order to ensure that all the valves are affected similarly by the oscillations, the phase difference A must correspond to an integral number of complete cycles of oscillation. In most cases, it is convenient for the phase difference A to correspond to a single complete cycle of oscillation. In such cases, for each 360° cycle of the crankshaft therefore there must be:

$$360/A=(360/720)n=n/2 \text{ oscillations}$$

The frequency of the oscillations must therefore be n/2 times the frequency of rotation of the crankshaft.

In the case of an engine in which the camshaft operates the valves of two cylinders; i.e., where $n=2$, the engine will also operate satisfactorily when the phase difference A between the two cylinders corresponds to two complete cycles of oscillation. In this case, the frequency of oscillation is n times crankshaft frequency. Where the crankshaft operates a single cylinder ($n=1$), satisfactory results can be obtained where the cam drive mechanism produces four complete cycles of oscillation when the frequency of oscillation is 2n times that of the crankshaft. Thus, for a camshaft drive mechanism arranged to drive a camshaft which operates the valves of n cylinders, the frequency of the oscillations should be f times the frequency of rotation of the crankshaft, where $f=2n$ when $n=1$; $f=n/2$ or n when $n=2$; and $f=n/2$ when $n=3$ or more.

Figure 6:
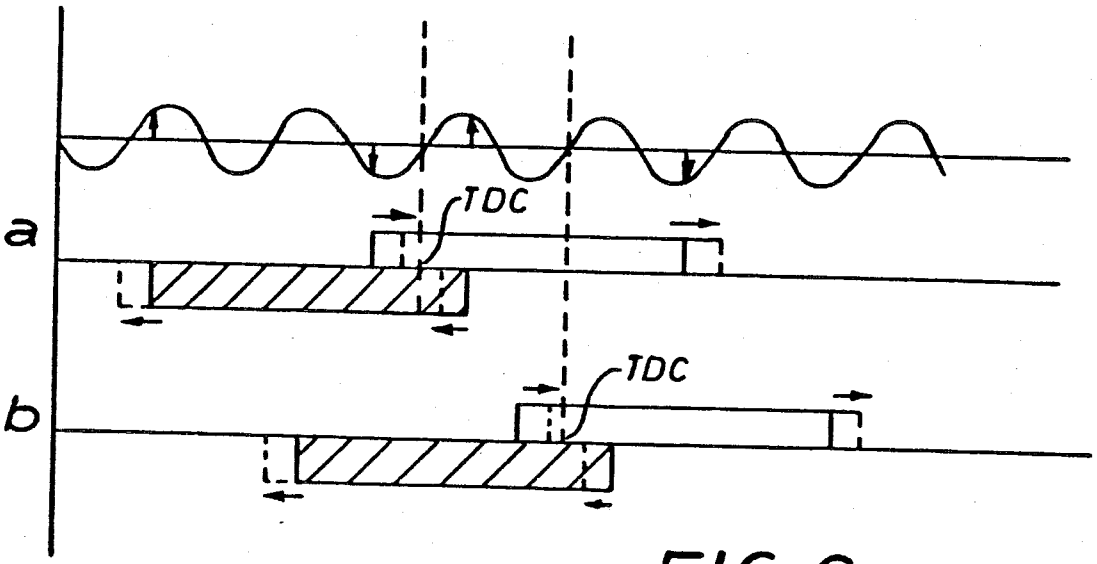
FIGS. 6 to 10 are graphical illustrations of the operation of the valves in engines differing from the engine of FIGS. 1 to 5 and embodying the invention.

Referring now to FIG. 6, the operation of a 6-cylinder in-line engine is illustrated. In this engine, each piston is out of phase with the other by a phase angle A or 120°. In order to ensure that the oscillations combined with the circular motion of the camshaft produce the same variations in the opening periods of the valves in each cylinder, the frequency of oscillations (n/2 as explained above) is increased to 6/2 or 3 times that of the crankshaft.

The effect of the oscillations is illustrated in FIG. 6, the first cylinder exhaust valve being indicated by a shaded line, as previously. It can be seen that both the opening and closing of the exhaust valve is advanced by about 20° in the cycle, and both the opening and closing of the intake valve is retarded by about 20°. Thus, although the period in each cycle for which each valve is open is substantially unchanged, the period during which both the intake valve and the exhaust valve are open simultaneously is reduced. Such a reduction improved fuel efficiency at low engine speeds and low loads.

The areas indicated at (b) illustrate the operation of the second cylinder, which is 120° out of phase with the first cylinder. Since the phase angle difference between the two cylinders corresponds to an integral number of cycles of oscillations, the operation of the intake and exhaust valves of the second cylinder will be affected in exactly the same manner as those of the first cylinder. Since all the remaining cylinders are 120°, or an integral multiple thereof, out of phase with the others, the same effect will be produced in each cylinder.

Figure 7:
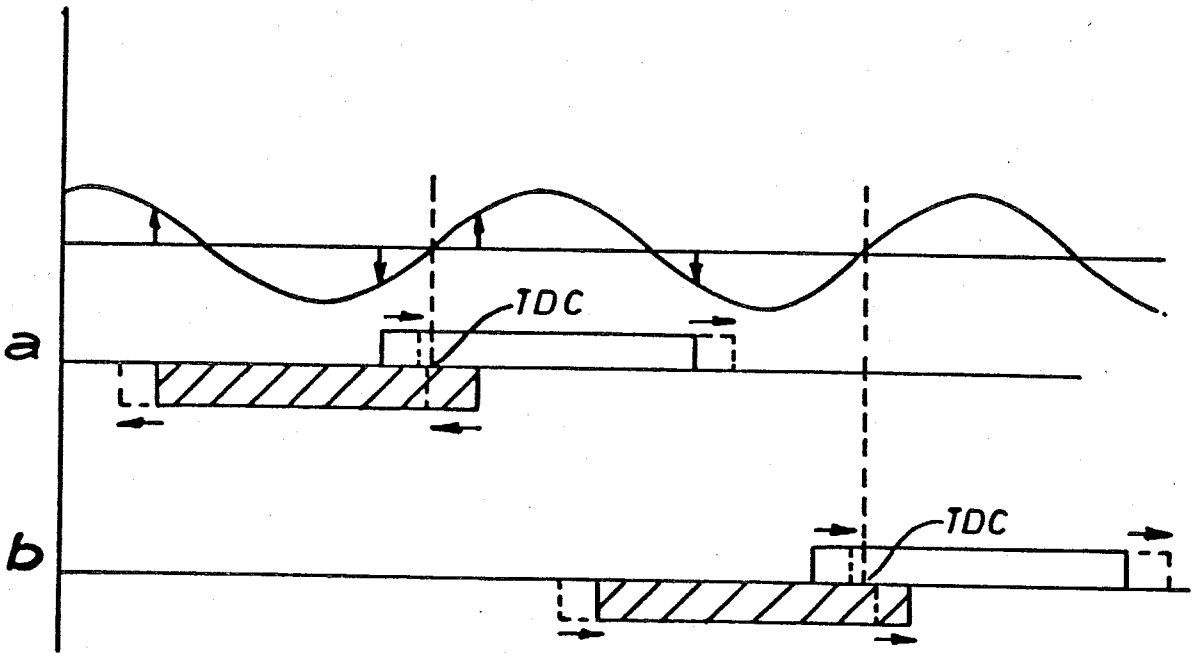

FIG. 7 is a diagram similar to FIG. 6 illustrating the operation of another embodiment of the invention as applied to an engine in which the camshaft operates the valves of two cylinders, the position of which is out of phase by a phase angle A of 360°. In this case, the oscillations have a frequency n/2 or $2/2=1$ times the frequency of the crankshaft. The areas indicated at (a) illustrate the operation of the valves of the first cylinder. It can be seen that a similar effect to that for the 6-cylinder engine is produced in that the absolute periods for which the exhaust and inlet valves are opened are unchanged, but the period for which both valves are opened together is reduced, improving fuel efficiency at low speeds and low loads.

Engines of this type are also capable of operation in accordance with the invention by a cam drive mechanism in which the oscillatory movement has a frequency of twice the frequency of rotation of the crankshaft. In such a case, the variations in the operation of the outlet and exhaust valves will be exactly as illustrated in FIG. 4.

It will be appreciated that the above description of the operation of engines having a camshaft which drives two cylinders is applicable either to two cylinder engines, or to 4-cylinder engines in which the cylinders are arranged in twos; e.g., horizontally opposed pairs, the valves of each pair being driven by its respective camshaft.

Figure 8:
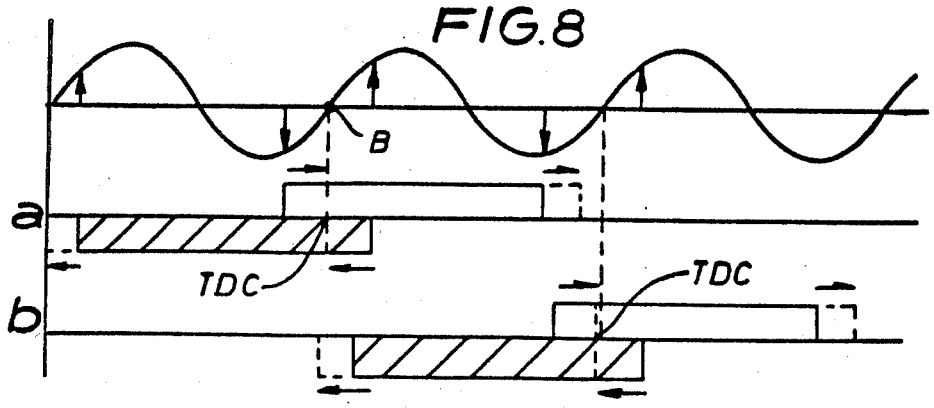

FIG. 8 is a diagram similar to FIG. 6 illustrating the operation of another embodiment of the invention as applied to a 3-cylinder engine. In-line 3-cylinder engines are uncommon; however, 6-cylinder engines in which the cylinders are arranged in two banks of three cylinders in each bank are usually driven from separate camshafts. FIG. 8, therefore, illustrates the operation of one such bank of cylinders. In either case, the three cylinders will be out of phase with each other by a phase angle of 240°, and the oscillations will have a frequency of $n/2$ or $3/2=1.5$ times the frequency of the crankshaft.

The effect of the oscillations on the first cylinder, as illustrated at (a), is again to reduce the periods for which the exhaust and inlet valves are open simultaneously without reducing the individual periods for which the valves are respectively open. It can also be seen that, as illustrated at (b), the 240° by which the second cylinder is out of phase with the first corresponds to an integral number of cycles of the oscillation. Hence, the valves of the second cylinder will be subjected to the same variations in opening and closing times. The same will also be true of the third cylinder.

Figure 9:
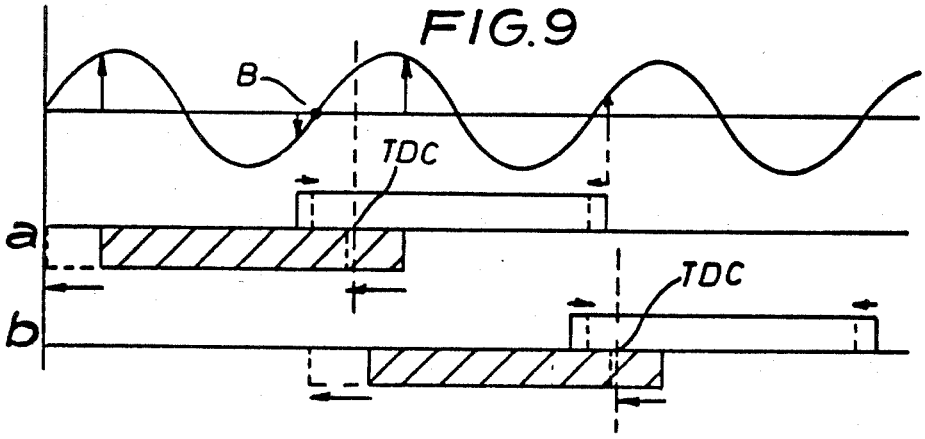

FIG. 9 illustrates an alternative mode of operation of the camshaft of the bank of three cylinders illustrated in FIG. 8. In this case, the phase relationship of the oscillations to the crankshaft is altered. Thus, in FIG. 8, the oscillatory movement starts to advance the timing of the valves at a point B which at 50 coincides with the TDC position of one of the other of the cylinders. If the phases of the oscillations are altered so that the point B occurs at or near the opening of the intake valve, the timings of the opening and closing of the exhaust valves are advanced by the same amount, while the timings of the opening and closing of the intake valves remain substantially the same. The period during which both valves are open is therefore still reduced without making any substantial change in the timing of the intake valve.

Figure 10:
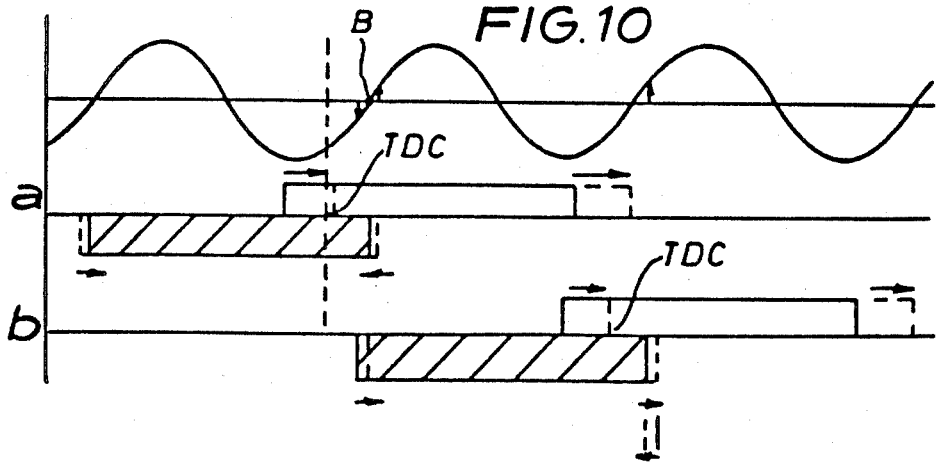

FIG. 10 illustrates a further alternative mode of operation of the camshaft of the bank of three cylinders illustrated in FIG. 8. In this case, the phase relationship of the oscillations to the crankshaft is altered so that the part B is at or near the closure of the exhaust valve. As a result, the timings of the opening and closing of the intake valve are retarded by the same amount, while the timings of the opening and closing of the exhaust valves remain substantially unchanged, so that the period during which both valves are open is again reduced.

The invention is also applicable to engines in which a camshaft drives the valves for a single piston, for example, single-cylinder engines or 2-cylinder engines in which the cylinders are horizontally opposed. The operation of the camshaft is as described in relation to the embodiments of the invention described hitherto except that the oscillations have a frequency of twice the frequency of rotation of the crankshaft. The variations in the operations of the inlet and exhaust valves will be exactly as illustrated in FIG. 4.

In all the embodiments of the invention described so far, the combination of the oscillatory movement with the circular movement of the camshaft has had the effect of reducing the periods for which the intake and exhaust valves are open simultaneously. It will be appreciated that this period could, in fact, be increased, if desired, by shifting the phase of the oscillations by one-half of one cycle. The desirability of such an arrangement would depend upon whether, in the absence of the oscillatory motion, the circular motion of the camshaft alone opens the inlet and exhaust valves together for a long or short period.

Figure 11:
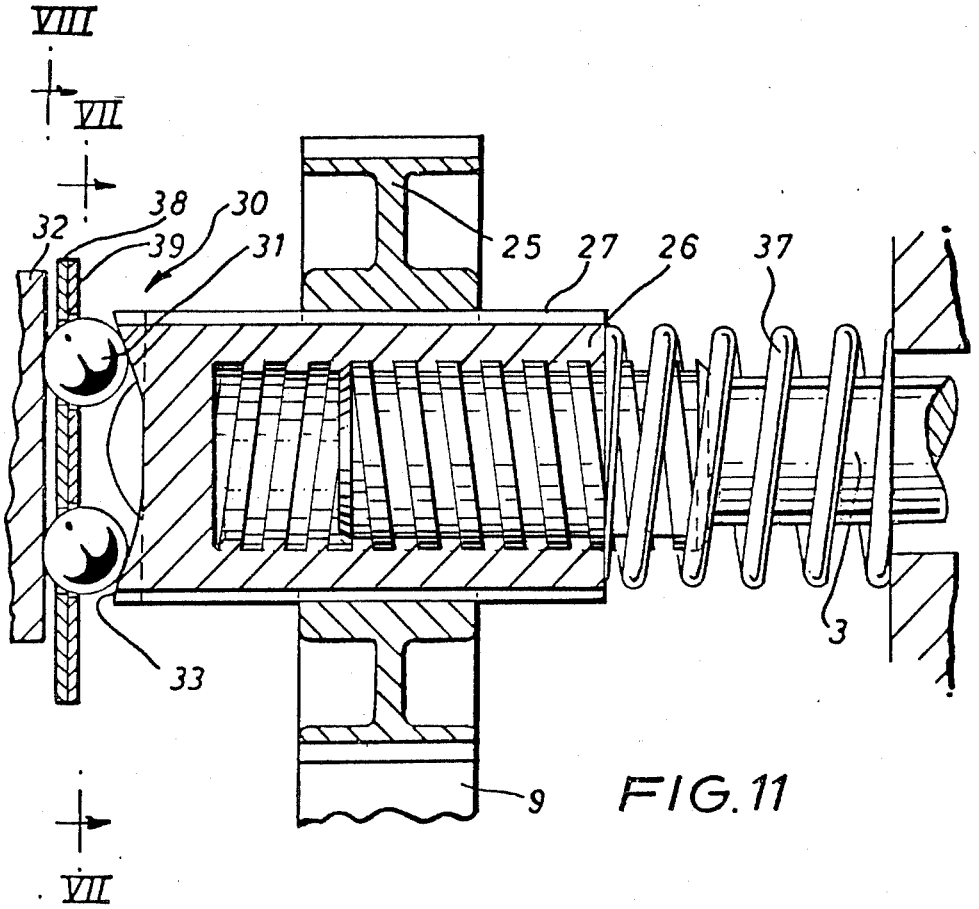
FIG. 11 is a sketch of part of an alternative engine constructed in accordance with the invention.
Figure 12:
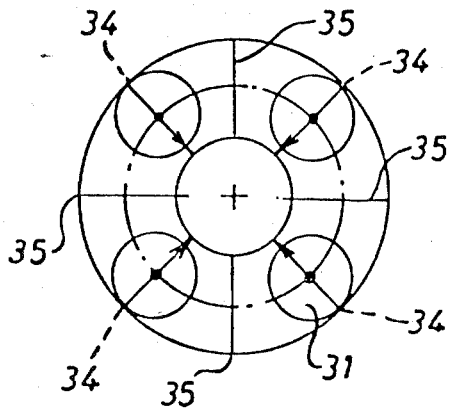
FIG. 12 is a sectional view taken along line VII—VII of FIG. 11.
Figure 13:
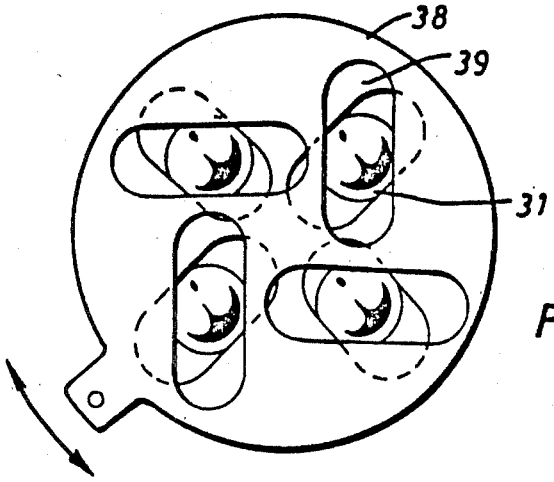
FIG. 13 is a sectional view taken along line VIII—VIII of FIG. 11.

FIGS. 11 to 13 illustrate an alternative cam drive mechanism. In this construction, a drive wheel 25 connected to the drive sprocket (FIG. 1) on the camshaft 3 by a timing belt or chain 9 is slideably mounted on a tube 26 by means of axial splines 27. The tube 26 has helical splines on its internal surface which engage with similar splines formed on one end of the camshaft 3. Axial movement of the tube 26 relative to the drive wheel 25 therefore causes rotation of the camshaft 3 relative to the drive wheel 25.

The axial movement of the tube 26 is affected by a cam mechanism which comprises a ball bearing race 30 in which a set of ball bearings 31 are held between a radial end face 33 of the tube 26, forming one track of the race, and a fixed vertical face 32.

The end face 33 of the tube 26 is provided with circumferential undulations, in the form of four peaks 34 and four troughs 35, the depths and heights of which increase in the radially outward direction. The ball bearings are retained between the two races by means of a cage which allows the radial position of the ball bearings to be adjusted, and a spring 37 which biases the tube 26 towards the end face 33. As seen in FIG. 13, the cage comprises two slotted plates 38, 39, the slots in one disc being radially disposed and the slots in the inlets disposed at 45° thereto. Rotation of one disc over the other causes the ball bearings to move radially along the radial slots.

In use, the drive wheel 25 is driven at half the speed of the crankshaft and the tube 26 rotates with the drive wheel 25 transmitting the rotation of the drive wheel 25 to the camshaft 3. In addition, the movement of the ball bearings over the undulations on the end face 33 of the tube 26 causes the tube 26 to oscillate axially at a frequency of twice that of the crankshaft. The axial oscillations are transformed into oscillatons about the axis of the crankshaft by the tube 26, the amplitude of the oscillations being controlled by the radial position of the ball bearings 31. The combined rotational and oscillatory movement is therefore equivalent to that described with reference to FIGS. 4 and 5. It will be appreciated that oscillations of different frequencies, as required by the alternative embodiments of the invention described with reference to FIGS. 6 to 10, can be obtained by modifying the shape of the end face 33 of the tube 26 to promote more or fewer undulations.

Figure 14:
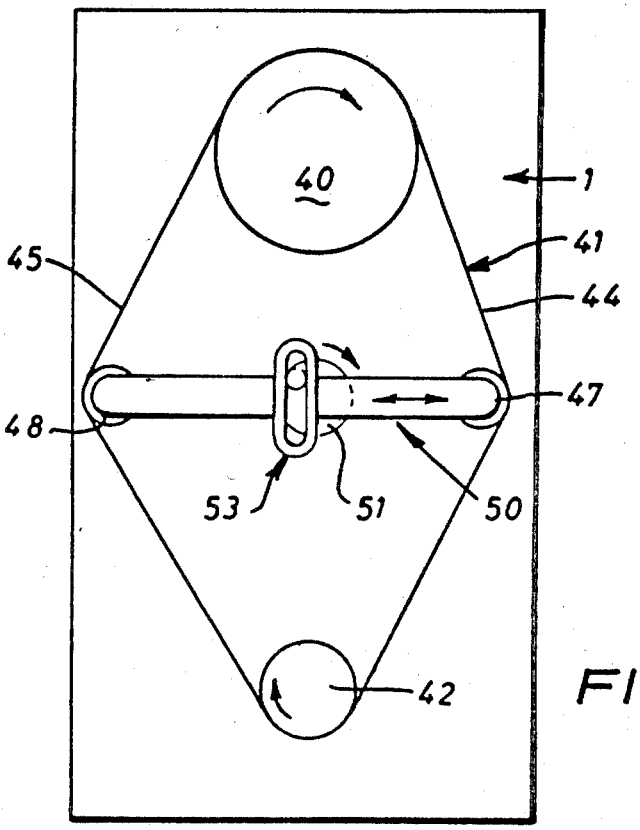
FIG. 14 is a sketch of a further alternative engine constructed in accordance with the invention.

FIG. 14 illustrates a still further alternative cam drive mechanism for a 4-cylinder engine in which the camshaft 3 is connected directly to a first drive wheel 40, which is, in turn, driven by a timing belt or chain 41 that runs over the second drive wheel 42 connected to the crankshaft 2. The two runs 44, 45 of the timing belt or chain each pass over a respective idler wheel 47, 48.

The idler wheels 47, 48 are mounted on opposite ends of a link 50 which is reciprocable by an eccentric drive comprising a rotatable drive member 51 driven by the crankshaft at twice the speed of the crankshaft and connected to the link 50 by a pin and slot connection 53.

In operation, the drive member 51 oscillates the link 50 at a frequency of twice the frequency of rotation of the crankshaft. Each oscillation causes synchronous movement of the idler wheels 47, 48 to move the runs of the drive belt radially in opposite directions from the line joining the centers of the first and second drive wheels 40, 42, so that the lengths of the runs 44, 45 increase and decrease alternatively without producing any net change in the length of the belt or chain. This produces an oscilating movement in the first drive wheel 40 which is transmitted to the camshaft 3, the amplitude of which varies with the amplitude of the reciprocations of the link 50. The movement of the camshaft 3 will also be analogous to that described with reference to FIGS. 4 and 5. Variations in the amplitude of the reciprocations may be produced by varying the eccentricity of the drive pin of the drive member 31. The frequency of the oscillations may be changed to match the requirements of engines with more or fewer cylinders by changing the rate of rotation of the drive members in relation to the rate of rotation of the crankshaft.

Figure 15:
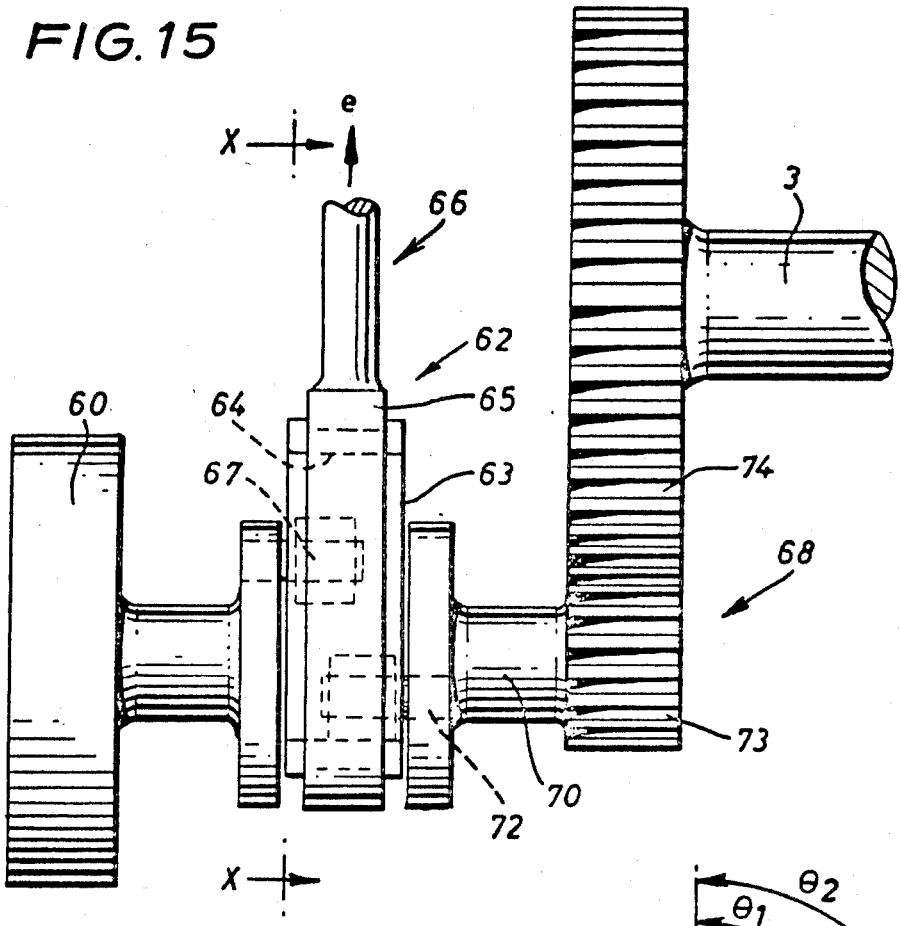
FIG. 15 is a sketch of a still further alternative engine constructed in accordance with the invention; and, FIG. 16 is a sectional view taken along the line X—X of FIG. 15.
Figure 16:
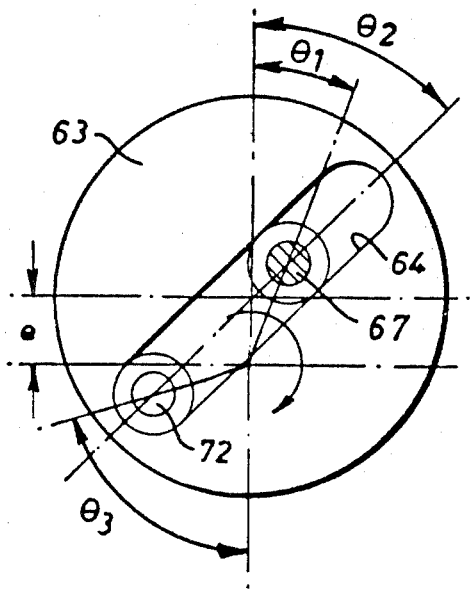

FIGS. 15 and 16 illustrate a still further alternative cam drive mechanism for a 4-cylinder engine in which a rotatable drive member 60 driven from the crankshaft of the engine by a timing belt or chain 9 at twice the speed of the engine is coupled to the camshaft 3 by an eccentric coupling indicated generally at 62. The eccentric coupling 62 comprises an intermediate member 63 which is in the form of a disc having a radial slot 64 extending axially therethrough. The disc is rotatably mounted in a bearing 65 which may be reciprocated in the radial direction by means of a control link 66 so that the axis of rotation of the intermediate member 63 may be positioned eccentrically with respect to the axis of rotation of the drive member 60 by an mount e.

The intermediate member 63 is connected to the drive member 60 by means of a first drive pin 67 which is mounted eccentrically with respect to the axis of rotation of the drive member 60. The pin 67 carries a roller or alternatively a sliding block which engages in the slot 64 of the intermediate member.

The intermediate member is drivingly connected to the camshaft by a 4:1 speed reduction gear indicated generally at 68. It includes a rotatable member 70 carrying a pinion 73 at one end that engages a pinion 74 on the end of the camshaft 3. The other end of the rotatable member 70 carries a second drive pin 72 that is positioned eccentrically with respect to the axis of rotation of the rotatable member 70. The pin 72 carries a roller or alternatively a sliding block that engages in the end of the slot 64 of the intermediate member opposite to that of the first drive pin 67.

In operation, when the axis of rotation of intermediate member 63 is aligned with the axis of rotation of the drive member 60 and the rotatable member 70, rotation of the drive member 60 at twice the speed of the crankshaft is transmitted directly through the intermediate member 63 to the rotatable member 70, and, hence, to the camshaft. Since the reduction gear 68 reduces the speed by a ratio of 4:1, the camshaft is driven at half the speed of the engine.

If the intermediate member 63 is displaced radially with respect to drive member 60 and the rotatable member 70, rotation of the drive member 63 through an angle $\theta_1$ will cause a rotation of the intermediate member 63 through an angle $\theta_2$. The angle $\eta_2$ varies approximately sinusoidally in relation to the angle of rotation of the drive member 60, $\theta_2$ being greater than $\theta_1$ during the first 180° of rotation of the drive member and less than $\theta_1$ during the second 180° of rotation. As the intermediate member rotates, it transmits drive through the second drive pin 72 to the rotatable member. Since the axis of rotation of the intermediate member 63 is also eccentric to the axis of rotation of the rotatable member 70, rotation of the intermediate member through an angle $\theta_2$ causes rotation of the rotatable member 70 through an angle $\theta_3$, which also varies approximately sinusoidally in relation to the angle of rotation of the intermediate member. The angle rotation of the rotatable member 70 with respect to the drive member 60 is therefore $(\theta_3-\theta_1)$, the value of which will vary approximately sinusoidally with the angle $\theta_1$ at a frequency equal to the frequency of rotation of the drive member 60.

The resultant motion of the rotatable member 70 is therefore the combination of the rotational movement of the drive member 60 at twice the speed of the crankshaft and an oscillating movement having a frequency equal to twice the frequency of rotation of the crankshaft. When this motion is transmitted to the camshaft 3 through the reduction gear 68, the camshaft 3 is rotated at half the speed of the crankshaft and oscillated at a frequency equal to twice the frequency of rotation of the crankshaft. Its movement is therefore as illustrated in FIGS. 4 and 5.

While the invention has been shown and described in its preferred embodiments, it will be clear to those skilled in the arts to which it pertains that many changes and modifications can be made without departing from the scope of the invention. For example, a similar mechanism can be used to drive the crankshaft of engines with more or fewer cylinders. However, the size of the drive member 60 and the ratio of the reduction gear 68 would require modification to ensure that the oscillations with the required frequency were produced at the desired camshaft speed. In general, the drive member will be driven at f (defined previously) times the speed of the crankshaft so that the frequency of the oscillations introduced will be f times the frequency of rotation of the crankshaft, and the speed change gear 68 is a reduction gear having a ratio of 2f:1 so that the frequency of rotation of the camshaft is half that of the crankshaft.

INDUSTRIAL APPLICABILITY

It will be clear from the foregoing that this invention has industrial applicability to motor vehicles and provides an engine construction with variable valve timing by the use of only a single camshaft complete with the cam drive mechanism of the invention.

What is claimed is:

1. A cam drive mechanism for driving the camshaft of a four-stroke internal combustion engine having one or more sets of n number of cylinders where n is a positive integer, a piston connected to a crankshaft and reciprocable in each cylinder and being either in phase or out of phase with any other piston in the set to which it belongs by a phase angle A°, or an integral multiple thereof, and a camshaft carrying a plurality of rotatable cams for actuating inlet and/or exhaust valves for each cylinder in the set, characterized in the cam drive mechanism comprising means for rotating the camshaft with a rotational movement which is a combination of a circular motion about its axis of rotation which has a predetermined phase relationship with the circular movement of the crankshaft and an oscillatory motion about its axis of rotation to advance and retard the angular position of the cams relative to the valves with which they are associated, the oscillatory motion having a predetermined phase relationship with the crankshaft, and means for varying the amplitude of the oscillatory motion whereby the timing of the opening and closing of the valves may be varied, characterized in that the speed of the circular movement of the camshaft is half the speed of the crankshaft and the frequency of oscillations of the camshaft is f times the frequency of rotation of the crankshaft, wherein:

$f=2n$ when the number of engine cylinders $n=1$;

$f=n$ or $n/2$ when $n=2$;

$f=n$ when $n/2=3$ or more;

the cam drive mechanism means comprising a rotatable drive member drivable by the crankshaft, and a connection between the drive member and camshaft for transmitting the rotary motion of the drive member thereto, said connection including a sleeve element rotatable by said drive element and axially slidable relative thereto and having a helically splined connection with the camshaft whereby axial movement of the sleeve element effects a rotation of the camshaft relative to the drive member, and means effecting a continuous reciprocation of the sleeve element first in one axial direction and then in the return opposite direction, to provide a continuous oscillatory movement of the camshaft relative to the drive member and crankshaft.

2. A mechanism according to claim 1 wherein the means for axially reciprocating the sleeve element comprises a cam mechanism.

3. A mechanism according to claim 2 wherein the cam mechanism comprises a ball bearing race having one track formed by a radial face of the sleeve element, the other track formed by a fixed radial face, one of the tracks comprising circumferential undulations, ball bearings positioned between the two races, and means for biasing the sleeve element towards the fixed radial face.

4. A mechanism according to claim 3 wherein the undulations vary in axial depth in the radial direction, and the means for varying the amplitude of the oscillations comprises means for varying the radial position of the ball bearings relative to the said one radial face.

* * * * *